US012378654B2

(12) United States Patent
Kim et al.

(10) Patent No.: US 12,378,654 B2
(45) Date of Patent: Aug. 5, 2025

(54) METHOD OF FORMING PLASMA-RESISTANT COATING LAYER WITH LOW BRIGHTNESS USING HEAT TREATMENT PROCESS OF RARE-EARTH METAL COMPOUND POWDER

(71) Applicant: KOMICO LTD., Anseong-si (KR)

(72) Inventors: Se Yong Kim, Anseong-si (KR); Min Gyu Lee, Anseong-si (KR); Joo Jin, Anseong-si (KR); Tae Soo Jang, Anseong-si (KR)

(73) Assignee: KOMICO LTD., Anseong-si (KR)

( * ) Notice: Subject to any disclaimer, the term of this patent is extended or adjusted under 35 U.S.C. 154(b) by 24 days.

(21) Appl. No.: 18/321,604

(22) Filed: May 22, 2023

(65) Prior Publication Data

US 2023/0374641 A1 Nov. 23, 2023

(30) Foreign Application Priority Data

May 23, 2022 (KR) ..... 10-2022-0062896

(51) Int. Cl.
*C23C 4/11* (2016.01)

(52) U.S. Cl.
CPC ..... *C23C 4/11* (2016.01)

(58) Field of Classification Search
CPC ..... C23C 4/02; C23C 4/10; C23C 4/11; B22F 1/05; B22F 1/052; B22F 1/054; B22F 1/056; B22F 1/07; B22F 1/142; B22F 2301/45; B22F 2302/25; B22F 2303/45; B22F 2304/054; B22F 2304/056; B05D 1/02; B05D 1/10; B05D 1/12; B05D 2401/32
See application file for complete search history.

(56) References Cited

U.S. PATENT DOCUMENTS

| | | | | |
|---|---|---|---|---|
| 10,272,467 | B2 * | 4/2019 | Yi | C23C 24/04 |
| 10,968,507 | B2 * | 4/2021 | Iwasaki | C23C 28/042 |
| 10,982,331 | B2 * | 4/2021 | Lee | H01J 37/32495 |
| 2020/0035463 | A1 * | 1/2020 | Sun | H01J 37/32495 |

FOREIGN PATENT DOCUMENTS

| | | | |
|---|---|---|---|
| KR | 20020053563 | A | 7/2002 |
| KR | 100454987 | B1 | 11/2004 |
| KR | 10100011576 | A * | 2/2010 |
| KR | 20130123821 | A | 11/2013 |
| KR | 20170080123 | A | 7/2017 |

* cited by examiner

*Primary Examiner* — William P Fletcher, III
(74) *Attorney, Agent, or Firm* — NKL Law; Jae Youn Kim

(57) ABSTRACT

A method of forming a plasma-resistant coating layer with low brightness includes: (a) performing a heat treatment process on a primary rare-earth metal compound powder having a grain size in a range of 20 nm to 60 nm to prepare a secondary rare-earth metal compound powder, (b) transferring the secondary rare-earth metal compound powder, and (c) spraying the transferred secondary rare-earth metal compound powder onto a substrate to form a rare-earth metal compound coating layer on the substrate. In the transferring transfer, a carrier gas is used to transfer the secondary rare-earth metal compound powder. The secondary rare-earth metal compound powder obtained through the heat treatment process has a grain size in a range of 70 nm to 150 nm, and the rare-earth metal compound coating layer has a brightness value of 50 or less.

6 Claims, 8 Drawing Sheets

FIG. 3E
FIG. 3F
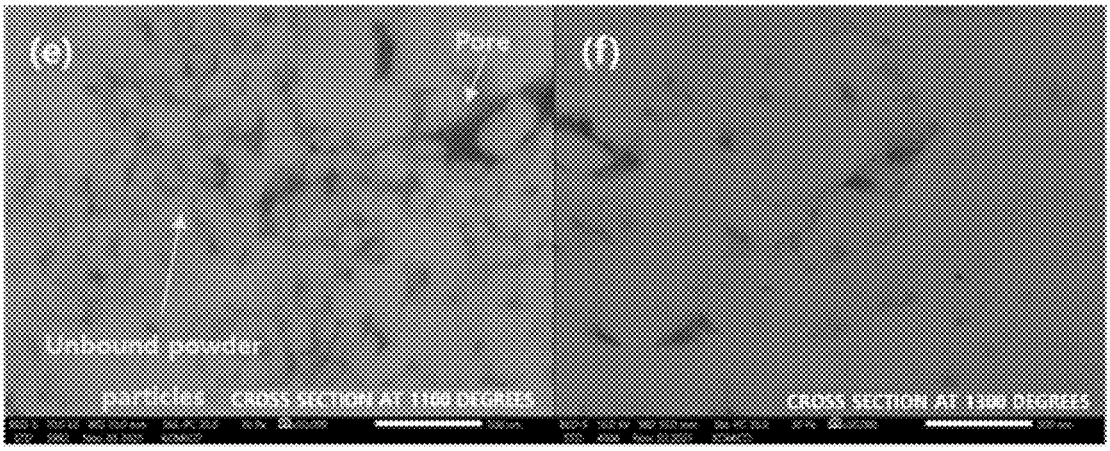
FIG. 4A
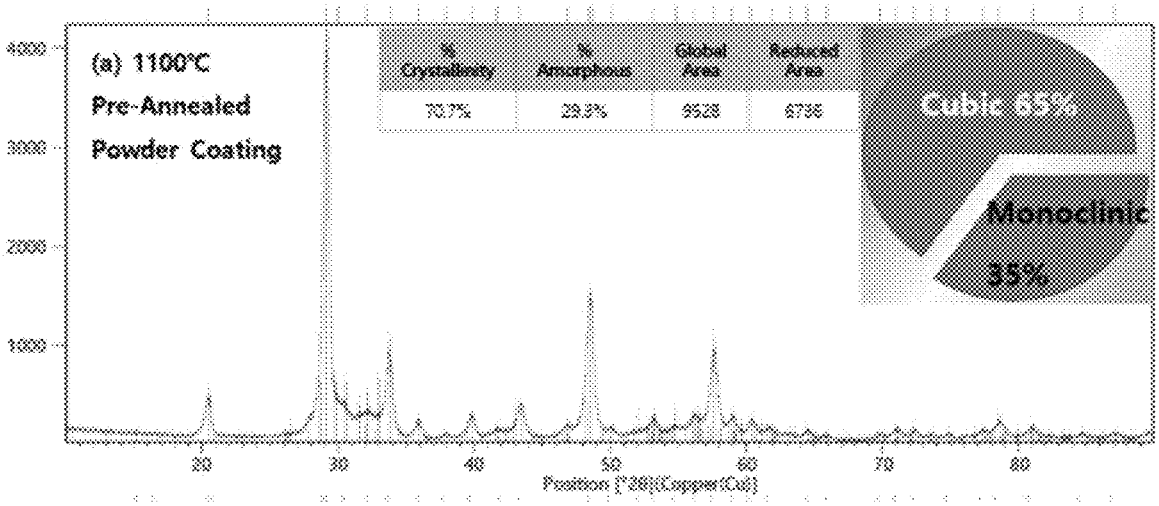

FIG. 5A (a)

| Map Sum Spectrum (1100℃ Pre-Annealed Powder Coating) | | | |
|---|---|---|---|
| Element | Wt% | Wt% Sigma | Atomic % |
| O | 22.58 | 0.23 | 61.84 |
| Y | 77.42 | 0.23 | 38.16 |
| Total: | 100.00 | | 100.00 |

FIG. 5B (b)

| Map Sum Spectrum (1300℃ Pre-Annealed Powder Coating) | | | |
|---|---|---|---|
| Element | Wt% | Wt% Sigma | Atomic % |
| O | 20.55 | 0.21 | 58.97 |
| Y | 79.45 | 0.21 | 41.03 |
| Total: | 100.00 | | 100.00 |

| Pre-Annealing Temperature of $Y_2O_3$ Powder (℃) | | COMPARATIVE EXAMPLE 2 | EXAMPLE 2 |
|---|---|---|---|
| Digital Image | |  |  |
| POROSITY (%,x10,000) | |  |  |
| | | 9.18 | 3.95 |
| Nano-Indentor (HV) | | 378.9 | 653.5 |
| Adhesion (mN) | | 8,034 | 12,943 |
| Color | L | 55.14 | 39.95 |
| | a | -0.49 | -0.06 |
| | b | -7.63 | -3.08 |
| EMISSIVITY (0~100) | | 0.47 | 0.59 |
| REFLECTANCE (GU) | | 1.1 | 0.7 |
| XRD | Crystallinity | 70.70% | 66.70% |
| | Crystal Structure | Cubic: 65%, Monodinic: 35% | Cubic: 39%, Monoclinic: 61% |

METHOD OF FORMING PLASMA-RESISTANT COATING LAYER WITH LOW BRIGHTNESS USING HEAT TREATMENT PROCESS OF RARE-EARTH METAL COMPOUND POWDER

CROSS-REFERENCE TO RELATED APPLICATION

The present application claims priority to Korean Patent Application No. 10-2022-0062896, filed on May 23, 2022, the entire contents of which are incorporated herein for all purposes by this reference.

BACKGROUND OF THE DISCLOSURE

1. Field of the Disclosure

The present disclosure relates to a method of forming a plasma-resistant coating layer. More particularly, the present disclosure relates to a method of forming a plasma-resistant coating layer with low brightness applied to a semiconductor manufacturing process involving semiconductor etching equipment, and to a plasma-resistant coating layer.

2. Description of the Related Art

Facility chambers used in semiconductor manufacturing processes are typically constructed using anodized aluminum alloys or ceramic bulks, such as alumina and the like, for insulation. Recently, corrosion resistance to highly corrosive gas, plasma, or the like used in semiconductor manufacturing processes, such as deposition equipment using chemical vapor deposition (CVD) and the like, etching equipment using plasma etching, or the like, has been even further required. Accordingly, to obtain high corrosion resistance as described above, the chambers are currently being constructed by methods, such as plasma spraying or thermal spraying of ceramic, such as alumina and the like, onto the aluminum alloy.

In addition, high-temperature processes, such as a heat treatment process, chemical vapor deposition, and the like, account for the majority of semiconductor manufacturing processes performed in the chamber, so the chambers are required to be heat resistant as well. That is, members of semiconductor manufacturing equipment, such as the chambers, are required to be insulative, heat-resistant, corrosion-resistant, and plasma-resistant. In addition, maintaining strong bonding strength between a coating layer and a substrate is necessary to prevent delamination of the coating layer, thereby minimizing particle generation during the manufacturing process and wafer contamination caused by the generated particles.

For this reason, commonly used chemical vapor deposition (CVD), physical vapor deposition (PVD), sputtering, and the like have been conventionally applied. However, these methods are related to thin layer formation processes. Therefore, there is a problem in that a process takes an excessively long time to form a thick layer that satisfies the requirements such as corrosion resistance and the like. In addition, it is problematic that strong bonding strength between a substrate and a coating layer is difficult to be obtained.

Furthermore, Korean Patent No. 10-0454987 discloses a thick layer coating method through a plasma spraying process for coating a thick layer having a thickness of 100 μm or greater. However, when coating the thick layer through the plasma spraying process, there is a problem in that a dense coating layer is difficult to be formed (Patent Document 0001).

On the other hand, an aerosol deposition method is a method of spraying an aerosol containing ceramic particles from a nozzle onto a substrate, causing the particles to collide with the substrate, and using the collision force to form a ceramic coating layer on the substrate. Korean Patent Application Publication No. 10-2002-0053563 has been disclosed in the related art (Patent Document 0002).

Hereinafter, existing technology in the art to which the present disclosure belongs will be briefly described. Then, the technical details to be distinctively achieved by the present disclosure will be described.

Korean Patent Application Publication No. 10-2013-0123821 (filed Nov. 13, 2013) relates to a plasma-resistant coating layer, which includes: a first amorphous coating layer formed by performing plasma spray coating on spray coating powder in which 30 wt % to 50 wt % of aluminum oxide and 50 wt % to 70 wt % of yttrium oxide are mixed on a to-be-coated target requiring plasma resistance; and a second coating layer formed on the first coating layer by an aerosol deposition method and having higher density and better plasma resistance than the first coating layer. In addition, a technology for forming a plasma-resistant coating layer with plasma resistance, high withstand voltage level, and high electrical resistance is described (Patent Document 0003).

In addition, Korean Patent Application Publication No. 10-2017-0080123 (filed Jul. 10, 2017) relates to a plasma-resistant coating layer, and specifically to a technology for forming a plasma-resistant coating layer. In the technology, chemical resistance is obtainable by minimizing open channels and open pores of a coating layer through double sealing with aerosol deposition and hydration treatment, after spray coating of a first rare-earth metal compound, and plasma corrosion resistance is obtainable due to a dense rare-earth metal compound coating layer, simultaneously.

However, in the plasma-resistant coating layers containing multilayer-structured coating layers prepared according to Patent Documents 3 and 4, problems of particle generation and delamination resulting from a decrease in bonding strength between the coating layers may still remain. As a result, there is a need for a formation technology of a plasma-resistant coating layer with durability and a long life span.

Furthermore, to overcome such problems, an enhancement process in which a coating layer positioned on a substrate is subjected to heat treatment at high temperatures (in a range of 800° C. to 1100° C.) to enhance the interfacial adhesion between the coating layer and the substrate has been performed in the related art, as illustrated in FIG. 1. However, the enhancement process of the coating layer requires about 26 hours to 28 hours, which is time-consuming and expensive in manufacturing plasma-resistant members.

Thus, the inventors of the present disclosure recognized limitations in such formation methods of plasma-resistant coating layers. As a result of repeatedly conducting research on a formation method in which a thin layer has excellent plasma resistance while bonding strength between coating layers is optimized, the present disclosure has been completed.

DOCUMENT OF RELATED ART

Patent Document (Patent Document 1) Korean Patent No. 10-0454987

(Patent Document 2) Korean Patent Application Publication No. 10-2002-0053563

(Patent Document 3) Korean Patent Application Publication No. 10-2013-0123821

(Patent Document 4) Korean Patent Application Publication No. 10-2017-0080123

SUMMARY OF THE INVENTION

One of the main objectives of the present disclosure is to provide a method of forming a plasma-resistant coating layer in which the bonding strength of the coating layer is excellent, and plasma resistance is enhanced.

In addition, another objective of the present disclosure is to provide a plasma-resistant member on which the plasma-resistant coating layer is formed, using the method of forming the plasma-resistant coating layer.

To achieve the above objectives, the present disclosure provides a method of forming a plasma-resistant coating layer with low brightness, the method includes (a) performing a heat treatment process on a primary rare-earth metal compound powder having a grain size in a range of 20 nm to 60 nm to prepare a secondary rare-earth metal compound powder, (b) transferring the secondary rare-earth metal compound powder, and (c) spraying the transferred secondary rare-earth metal compound powder onto a substrate to form a rare-earth metal compound coating layer on the substrate. In the transferring, a carrier gas is supplied to transfer the secondary rare-earth metal compound powder. The secondary rare-earth metal compound powder obtained through the heat treatment process has a grain size in a range of 70 nm to 150 nm, and the rare-earth metal compound coating layer has a brightness value of 50 or less.

In one preferred embodiment of the present disclosure, the rare-earth metal compound may be selected from the group consisting of yttria ($Y_2O_3$), yttrium fluoride (YF), and yttrium oxyfluoride (YOF).

In one preferred embodiment of the present disclosure, in the performing, the heat treatment process may be performed in a temperature range of 1,200° C. to 1,400° C.

In one preferred embodiment of the present disclosure, in the performing, the heat treatment process may be performed in a temperature range of 1,250° C. to 1,350° C.

In one preferred embodiment of the present disclosure, the rare-earth metal compound coating layer may have a thickness in a range of 1.0 nm to 3.0 nm.

In one preferred embodiment of the present disclosure, the rare-earth metal compound coating layer may have a porosity in a range of 2 vol % to 5 vol %.

In one preferred embodiment of the present disclosure, the rare-earth metal compound coating layer may have an adhesive strength of 10,000 mN or higher.

In one preferred embodiment of the present disclosure, the secondary rare-earth metal compound powder obtained through the heat treatment process may have a grain size in a range of 70 nm to 150 nm and an average diameter (D50) in a range of 8 pun to 12 μm.

Another preferred embodiment of the present disclosure provides a low-brightness, plasma-resistant coating layer formed by the above formation method, the coating layer having an emissivity of 0.5 or higher.

In one preferred embodiment of the present disclosure, a monoclinic structure in the coating layer may account for 40% or more of the entire crystal structure.

In a plasma-resistant coating layer according to the present disclosure, changes in light absorption (changes in color) of the coating layer were measured by varying powder temperatures. As a result, with the increased powder heat treatment temperature, the color was gradually darkened, and the emissivity value increased. Therefore, the plasma-resistant coating layer, according to the present disclosure, can stabilize an initial atomic layer deposition (ALD) process by achieving uniform heat distribution in areas subjected to the ALD process due to an increase in heat absorption rate.

In addition, when increasing the powder heat treatment temperature, the plasma-resistant coating layer, according to the present disclosure, obtains improved mechanical properties not inferior to those of bulks. Furthermore, a collision energy, which is the source of coating layer formation, is increased, leading to increases in the density, strength, and adhesive strength of the coating layer formed thereby.

Moreover, according to the present disclosure, the time required for an enhancement process of a coating layer can be saved, thereby increasing the production efficiency of a plasma-resistant coating layer.

BRIEF DESCRIPTION OF THE DRAWINGS

FIGS. 3A, 3C, and 3E show scanning electron microscope (SEM) images of a coating layer formed according to Comparative Example 2, and FIGS. 3B, 3D, and 3F show SEM images of a coating layer formed according to Example 2 in the present disclosure;

FIGS. 4A, 4B, and 4C show X-ray powder diffraction (XRD) results of coating layers formed according to Comparative Example 2, Example 1, and Example 2, respectively;

FIGS. 5A and 5B show energy dispersive spectroscopy (EDS) mapping results of coating layers formed according to Comparative Example 2 and Example 2, respectively;

DESCRIPTION OF THE PREFERRED EMBODIMENTS

Figure 1:
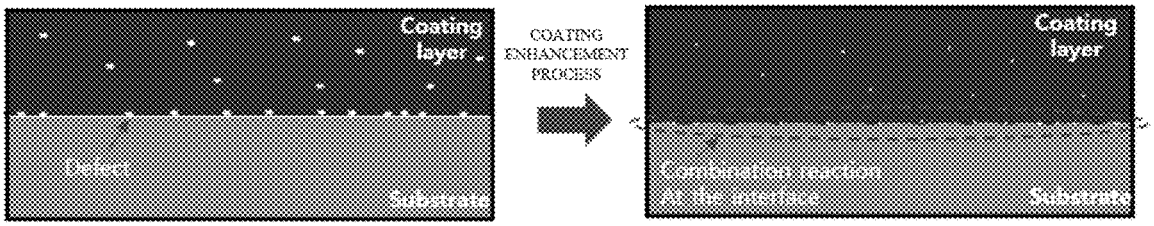
FIG. 1 illustrates a schematic diagram of an interface between a substrate and a coating layer to which an enhancement process of the coating layer is applied.
Figure 2A:
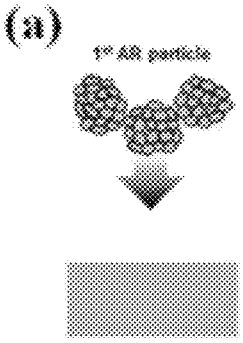
FIGS. 2A to 2D illustrate a schematic diagram for explaining an aerosol deposition mechanism using a collision energy of conventional aerosol powder particles.
Figure 2B:
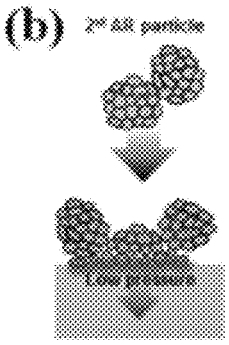
Figure 2C:
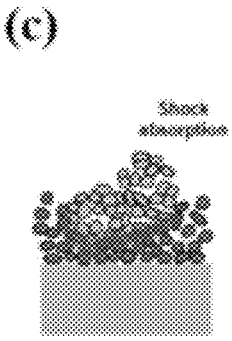
Figure 2D:
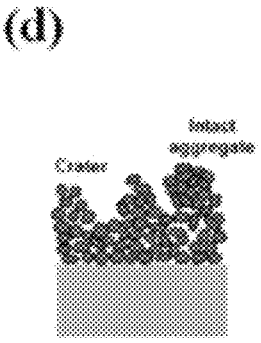
Figure 2E:
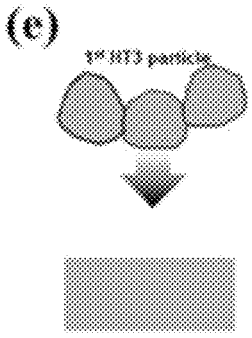
FIGS. 2E to 2H illustrate a schematic diagram for explaining a deposition mechanism using a collision energy of powder particles subjected to heat treatment at high temperatures according to the present disclosure.
Figure 2F:
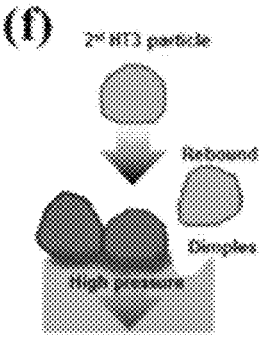
Figure 2G:
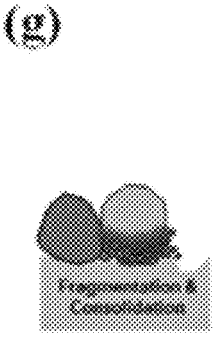
Figure 2H:
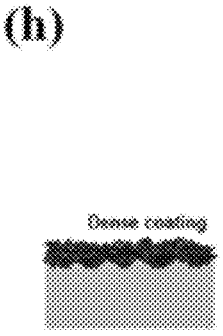
Figure 3A:
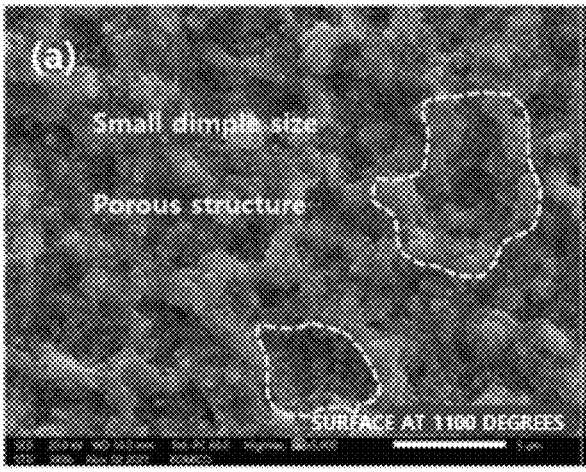
Figure 3B:
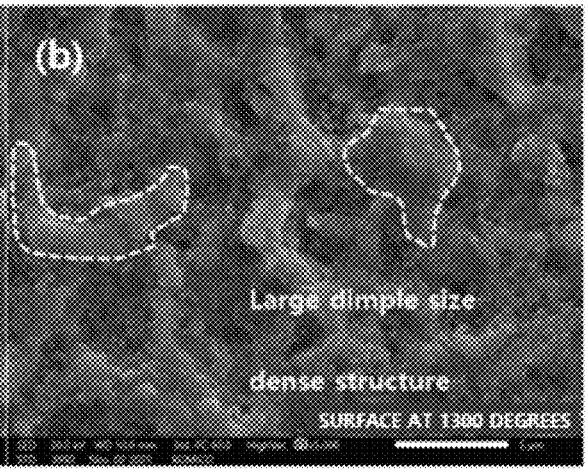
Figure 3C:
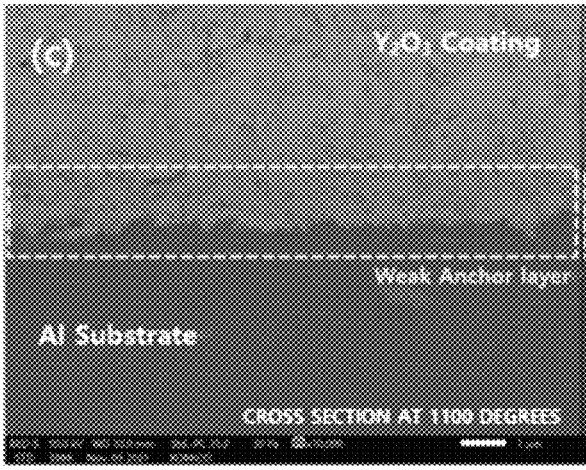
Figure 3D:
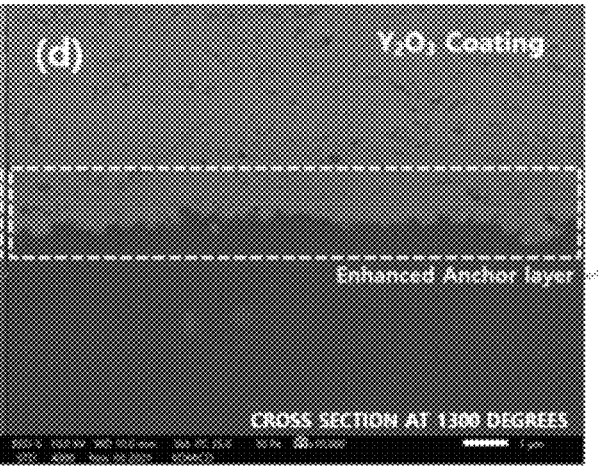

Unless defined otherwise, all terms including technical and scientific terms used herein have the same meaning as commonly understood by those skilled in the art to which the present disclosure belongs. Typically, the nomenclature used herein is well-known and commonly used in the art.

It will be further understood that the terms "comprise", "include", "have", etc. when used in this specification, specify the presence of stated features, integers, steps, operations, elements, components, and/or combinations thereof, but do not preclude the presence or addition of one or more other features, integers, steps, operations, elements, components, and/or combinations thereof.

One aspect of the present disclosure provides a method of forming a plasma-resistant coating layer with low brightness. The method includes (a) performing a heat treatment process on a primary rare-earth metal compound powder having a grain size in a range of nm to 60 nm to prepare a secondary rare-earth metal compound powder, (b) transferring the secondary rare-earth metal compound powder, and (c) spraying the transferred secondary rare-earth metal compound powder onto a substrate to form a rare-earth metal compound coating layer on the substrate. In the transferring, a carrier gas is supplied to transfer the secondary rare-earth metal compound powder. The secondary rare-earth metal compound powder obtained through the heat treatment process has a grain size in a range of 70 nm to 150 nm, and the rare-earth metal compound coating layer has a brightness value of 50 or less.

FIGS. 2A to 2D illustrate a schematic diagram for explaining an aerosol deposition mechanism.

To explain the mechanism in further detail as illustrated in FIGS. 2A to 2D, initial aerosol particles colliding with the substrate form an anchor layer, and the following aerosol particles, continuously impinging on a structure formed by the preceding powder particles, collide with the previously colliding particles and break the same into pieces to form a coating layer (hammering effect).

On the other hand, in deposition according to the present disclosure, when the size and density of powder particles are increased by high-temperature heat treatment as illustrated in FIGS. 2E to 2H, a collision energy, which is the source of the coating layer formation, is increased, leading to increases in the density, strength, and adhesive strength of the coating layer formed thereby.

Therefore, in the method of forming the plasma-resistant coating layer according to the present disclosure, using the deposition method of the present disclosure in which the powder particles are transferred using the carrier gas and then coated in a vacuum chamber through a nozzle, the secondary rare-earth metal compound powder, which has a high collision energy, a grain size in a range of 70 nm to 150 nm, and improved mechanical properties due to the heat treatment, can form a colored plasma-resistant coating layer having excellent mechanical properties and bonding strength between the substrate and the coating layer on the substrate.

In the method of forming the plasma-resistant coating layer according to the present disclosure, the heat treatment process is first performed on the primary rare-earth metal compound powder having a grain size in a range of 20 nm to 60 nm to prepare the secondary rare-earth metal compound powder [(a)].

The rare-earth metal compound of the primary and secondary rare-earth metal compound powders may include yttria ($Y_2O_3$), yttrium fluoride (YF), yttrium oxyfluoride (YOF), or a mixture thereof, and preferably is yttria ($Y_2O_3$).

The primary rare-earth metal compound powder preferably has a grain size in a range of 20 nm to 60 nm.

In one embodiment, before being subjected to the heat treatment process, the primary rare-earth metal compound powder preferably has a grain size in a range of 20 nm to 60 nm and an average diameter (D50) in a range of 3 μm to 8 μm.

Through the heat treatment process performed according to the present disclosure, the primary rare-earth metal compound powder is converted into the secondary rare-earth metal compound powder having a grain size in a range of 70 nm to 150 nm and an average diameter (D50) in a range of 8 μm to 12 μm. As a result, the secondary rare-earth metal compound powder obtains improved mechanical properties and high collision energy, leading to increases in the density, strength, and adhesive strength of the coating layer during the coating layer formation.

That is, the secondary rare-earth metal compound powder is obtained through the heat treatment process and mutually aggregates, thereby obtaining the grain size and the average diameter with increased volume. As the secondary rare-earth metal compound powder has the grain size and the average diameter with the increased volume, the powder particles can obtain high collision energy in the coating process in which the following powder particles are sprayed onto the substrate to form the coating layer. Accordingly, the bonding strength between the powder particles coated on the surface of the substrate may be increased.

The heat treatment process may be performed at a temperature in a range of 1,200° C. to 1,400° C., and preferably, in the range of 1,250° C. to 1,350° C. When the temperature of the heat treatment process is lower than 1,200° C., the secondary rare-earth metal compound powder obtained through the heat treatment process may fail to have a sufficiently large grain size and average diameter (D50). As a result, the bonding strength between the rare-earth metal compound coating layer and the substrate may be insufficiently improved. On the contrary, when the temperature of the heat treatment process exceeds 1,400° C., the secondary rare-earth metal compound powder may have an excessively large grain size.

Next, the carrier gas is supplied to transfer the secondary rare-earth metal compound powder obtained through the heat treatment in the (a) [(b)].

In this case, the carrier gas may be supplied at a flow rate in a range of 15 standard liters per minute (SLM) to 40 standard liters per minute (SLM). The carrier gas may include, for example, an inert gas such as argon.

Subsequently, the powder is sprayed onto the substrate to form the rare-earth metal compound coating layer on the substrate. As a result, a plasma-resistant member including the substrate and the rare-earth metal compound coating layer is formed [(c)].

In this case, the substrate on which the rare-earth metal compound coating layer is formed of: metal including iron, magnesium, aluminum, or alloys thereof; ceramic material including $SiO_2$, MgO, $CaCO_3$, or alumina; or polymeric material including polyethylene terephthalate, polyethylene naphthalate, polypropylene adipate, or polyisocyanate. However, the substrate is not limited thereto.

The rare-earth metal compound coating layer is a high-density rare-earth metal compound layer that is formed on the substrate, which preferably has a pore content in a range of 2 vol % to 5 vol % and a thickness in a range of 1.0 μm to 30 μm.

First, as the pore content of the rare-earth metal compound coating layer increases, there is a problem in that the mechanical properties of the ultimately formed plasma-resistant coating layer are deteriorated. Therefore, the rare-earth metal compound coating layer preferably is dense and has a low pore content to obtain the mechanical properties of the plasma-resistant coating layer.

When the thickness of the rare-earth metal compound coating layer is smaller than 1 μm, the thickness itself is excessively small, and the plasma resistance thus may be difficult to be obtained in a plasma environment. On the contrary, when the thickness of the rare-earth metal compound coating layer exceeds 30 μm, there is a problem in that residual stress of the coating layer causes delamination, which may also occur during processing. Furthermore, the excessive use of the rare-earth metal compound may result in financial losses.

In one embodiment, in the deposition of the powders for forming the rare-earth metal compound coating layer using the carrier gas, the secondary rare-earth metal compound powder obtained through the heat treatment is loaded into the vacuum chamber, and a to-be-coated target is then placed in a deposition chamber. In this case, the secondary rare-earth metal compound powder is supplied from the vacuum chamber and sprayed by being introduced into the deposition chamber using the carrier gas. As the carrier gas, a condensed gas or an inert gas, such as hydrogen ($H_2$), helium (He), nitrogen ($N_2$), or the like, may be used, in addition to argon gas. Due to a pressure difference between the powder supply device and the deposition chamber, the carrier gas and the secondary rare-earth metal compound powder are sucked into the deposition chamber and then sprayed onto the to-be-coated target (substrate) at high speed through the nozzle. As a result, the spraying enables the rare-earth metal compound to be deposited, and a high-density rare-earth metal compound coating layer thus is formed. A deposition area of the rare-earth metal compound coating layer can be controlled to a desired size by laterally moving the nozzle. In addition, the thickness thereof is determined in proportion to a deposition time, that is, a spraying time.

The rare-earth metal compound coating layer may be formed by repeatedly performing the lamination of the secondary rare-earth metal compound powder two times or more using the deposition method described above.

In the present disclosure, the secondary rare-earth metal compound powder having a grain size in a range of 70 nm to 150 nm obtained through the heat treatment process in the (a) may obtain increased collision energy, which is the source of the coating layer formation, during the deposition process of the present disclosure in which the powder particles are transferred using the carrier gas and then deposited in the vacuum chamber through the nozzle. As a result, the density, strength, and adhesive strength of the coating layer formed thereby are improved.

In one embodiment, the rare-earth metal compound coating layer may have an adhesive strength of 10,000 mN or higher, preferably in a range of 10,000 mN to 14,000 mN, and more preferably in the range of 11,000 mN to 14,000 mN.

In general, when forming a coating layer using a deposition method in which powder particles are transferred using a carrier gas and then deposited in a vacuum chamber through a nozzle, the coating layer has a nanoscale crystal structure including numerous grain boundaries in the coating layer. In addition, lattice defects occur due to the collision energy generated during the deposition. As a result, the coating layer typically has poor mechanical properties than bulks. However, when increasing the powder heat treatment temperature, the mechanical properties not inferior to those of the bulks can be obtained.

In addition, the color of the deposited coating layer may vary with changes in the powder heat treatment temperature. The powder with increased size and density due to the increase in the heat treatment temperature generates more collision energy during the deposition. Thus, a microstructure of the coating layer is further refined, resulting in a change in the crystal structure. Likewise, strong collisions of powder particles generate strong electrical emissions on the surface and cause internal microdefects. Due to the microstructure, the changes in the crystal structure, and the microdefects, the color of the coating layer is darkened, and the absorption rate in the infrared range (IR) is increased. This leads to uniform heat distribution in process areas and a decrease in temperature deviation during an atomic layer deposition (ALD) process, and thus may help stabilize the initial ALD process.

Using the method of forming the plasma-resistant coating layer according to the present disclosure, parts of plasma devices, such as an electrostatic chuck, a heater, a chamber liner, a shower head, a CVD boat, a focus ring, a wall liner, and the like that are applied to the inside of the plasma device, may be manufactured into plasma-resistant members.

In particular, the rare-earth metal compound coating layer can be formed on a shower head. In the case of an existing ceramic coating layer formed by a vacuum deposition process using ceramic particles subjected to heat treatment at low temperatures, low adhesive strength leads to delamination of the coating layer and particle generation. As a result, there is a problem in that the life span of parts as well as the process yield of process equipment are reduced. On the other hand, the rare-earth metal compound coating layer, formed according to the present disclosure, has improved adhesive strength and physical strength and thus can be applied to a coating layer of a shower head.

In the plasma-resistant coating layer formed according to the present disclosure, a general colorimeter may be used to measure lightness (L), redness (a), and yellowness (b) values.

In this case, the closer the lightness (L) value to 0, the darker the color of the coating layer. On the contrary, the closer the lightness (L) value to 100, the whiter the color of the coating layer. In addition, when the redness (a) value is positive, the percentage of red is high. On the contrary, when the redness (a) value is negative, the percentage of green is high. Furthermore, when the yellowness (b) value is positive, the percentage of yellow is high. On the contrary, when the yellowness (b) value is negative, the percentage of blue is high.

When measuring the brightness value using the colorimeter described above, the plasma-resistant coating layer, formed according to the present disclosure, has the brightness value of 50 or less, which is lower than that of a coating layer formed by a conventional method.

This is because the crystal structure of the plasma-resistant coating layer, according to the present disclosure, and the microdefects (mainly oxygen vacancies) inside the coating layer lead to changes in the energy band gap of the material. As a result, the color of the coating layer is darkened, and the coating layer thus has the brightness value of 50 or less.

In addition, with the changes in the energy band gap of the material, the plasma-resistant coating layer, formed by the formation method of the plasma-resistant coating layer according to the present disclosure, has an increased light absorption rate in the visible light range as well as in the infrared range, thereby having an emissivity of 0.5 or higher.

Furthermore, a monoclinic structure of the plasma-resistant coating layer, formed by the formation method of the plasma-resistant coating layer according to the present disclosure, may account for 40% or more of the entire crystal structure.

This is because when forming the coating layer, an increase in the collision energy of the powder particles caused by the increase in the powder heat treatment temperature generates intense pressure and causes deformation, which results from the enhanced hammering effect. As a result, the crystal size of the coating layer is reduced, and the ratio of a monoclinic phase present under high pressure is increased.

Hereinafter, the present disclosure will be described in further detail with reference to embodiments. However, the following embodiments of the present disclosure are disclosed only for illustrative purposes and should not be construed as limiting the present disclosure.

(1) Heat Treatment Process of Yttria Powder

In Comparative Example 1, solid-state yttria ($Y_2O_3$) was used without processing.

In Comparative Example 2 and Examples 1 and 2, yttria was heated from room temperature to a temperature of 600° C. at a speed in a range of 50° C./hr to 200° C./hr, and then heated to maximum temperatures at a speed in a range of 50° C./hr to 150° C./hr. The respective maximum temperatures in Comparative Example 2 and Examples 1 and 2 are shown in Table 1. Yttria was subjected to heat treatment for 1 hour to 5 hours at the respective maximum temperatures, cooled to a temperature of 500° C. at a speed of 100° C./hr to 250° C./hr, and then naturally cooled to room temperature.

TABLE 1

| | Heat treatment temperature (° C.) | Grain Size (nm) | Powder average diameter (D50) (μm) |
|---|---|---|---|
| Comparative Example 1 | — | 50 | 6.5 |
| Comparative Example 2 | 1100 | 64 | 7.2 |
| Example 1 | 1200 | 90 | 8.5 |
| Example 2 | 1300 | 116 | 10.0 |

Figure 4B:
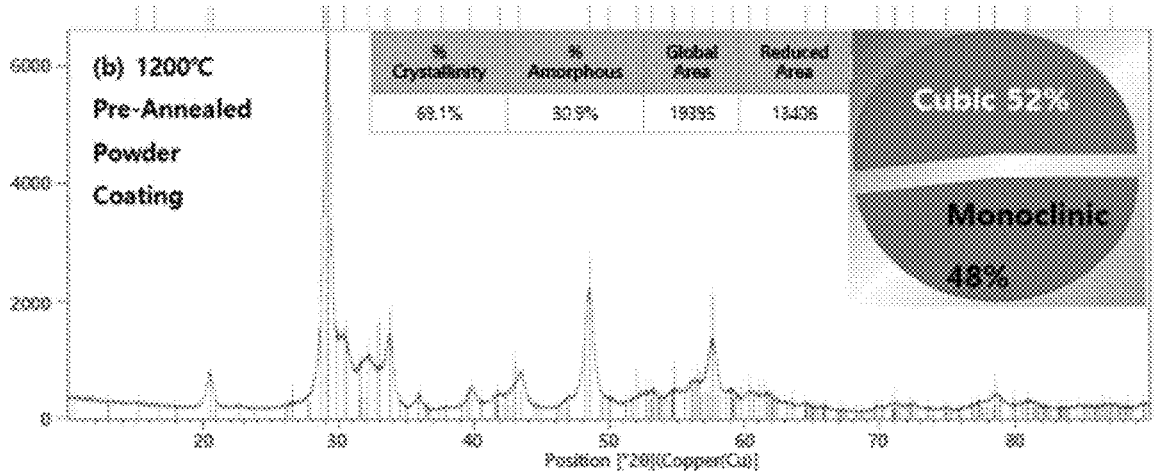
Figure 4C:
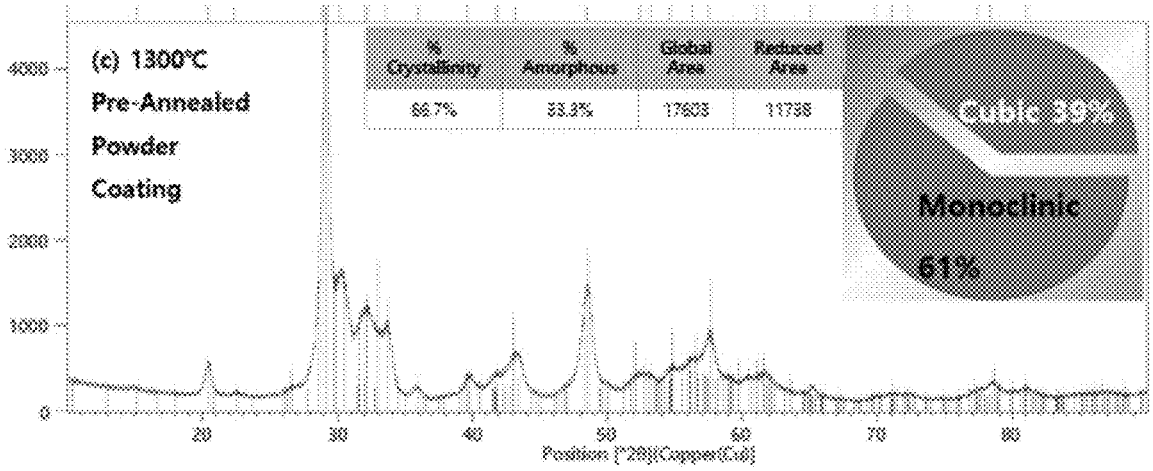

As shown in FIGS. 3 and 4, it was confirmed that as the heat treatment temperature was increased, recrystallization and grain growth of yttria particles occurred, and the grain growth rapidly increased at the heat treatment temperatures of 1100° C. or higher.

(2) Formation of Yttria Coating Layer

Deposition proceeded in a vacuum chamber under a low-vacuum condition. The maximum vacuum level was 1 mTorr, and a vacuum level during a process formed when supplying a carrier gas was in a range of 100 mTorr to 500 mTorr.

Ceramic powder, a coating raw material, was uniformly supplied from a supply device in a predetermined amount. At this time, the amount of the powder being supplied was managed at a level in a range of 3 g/min to 10 g/min.

The carrier gas flow carried away the supplied gas powder, followed by finally spraying the powder through a nozzle in the chamber. At this time, the carrier gas was supplied at a flow rate in a range of 25 SLM to 45 SLM, and an inert gas, such as Ar, $N_2$, and He, was used as a type of carrier gas.

When supplying the carrier gas, a pressure difference between the powder supply device and the vacuum chamber facilitated the carrier gas to be sucked into the vacuum chamber. Due to the gas flow generated at this time, the powder was mixed with the carrier gas and then transferred.

The transferred powder particles were continuously accelerated to be sucked into the vacuum chamber by the pressure difference while the speed when being sprayed through the nozzle reached the speed of sound. The accelerated powder particles collided with a substrate. Based on the collision energy generated at this time, a yttria coating layer having a thickness in a range of 3 μm to 15 μm was formed.

As shown in FIG. 3, with the increased powder heat treatment temperature, the coating layer was densely formed. As a result, the internal density of the coating layer was increased, and the porosity was decreased. In addition, the bonding between the deposited powder particles was enhanced, and the interfacial adhesive strength between the coating layer and the substrate was also increased.

Experimental Example 1: Scratch Test

TTX-MST3 (purchased from AntonPaar Co.) was used to perform a scratch test on the coating thin layer.

The substrate of a sample was 15×15×3T Al (60 series) with a surface roughness of 0.1 or less. In addition, a coating thickness was 10 μm, and a surface roughness was 0.05 μm or less.

When measuring the adhesive strength of the coating layer with the scratch test, the results thereof depend on the substrate types of sample, the coating thickness, and the coating surface roughness. Thus, such conditions are required to be taken into account when measuring adhesive strength. Measurement values were obtained by repeatedly performing the test 10 times.

Measurement conditions of TTX-MST3 (purchased from AntonPaar Co.) are as follows.

Linear Scratch
Type: Progressive
Begin Load (N): 1
End Load (N): 30
Loading rate (N/min): 58
Scanning load (N): 0.01
Speed (mm/min): 10
Length (mm): 5
Fn contact: 0.01 N
Fn speed: 5 N/s
Fn remove speed: 10 N/s
Approach speed: 2%/s
Speed (mm/min): 10 Pre-scan/post-scan return speed: 1.2 mm/min (Indenters)
Type: Rockwell
Material: Diamond
Radius (μm): 200

Experimental Example 2: Measurement of Elastic Modulus

TTX-MST3 (manufactured by AntonPaar) was used to measure the elastic modulus of the coating thin layer.

(Indentation Parameters)
Acquisition rate: 20.0 [Hz]
Linear loading
Max load: 100.00 mN
Loading rate: 600.00 mN/min
Unloading rate: 1500.00 mN/min
Pause: 5.0 s
Approach distance: 2000 nm
Approach speed: 2000 nm/min
Retract speed: 2000 nm/min
Z table retract: 1500 μm
Stiffness threshold: 500 ρN/μm (Indenters)
Type: Berkovich
Material: Diamond

TABLE 2

| | Heat treatment temperature (° C.) | Elastic modulus (GPa) |
|---|---|---|
| Comparative Example 2 | 1100 | 83.889 |
| Example 2 | 1300 | 110.346 |

Figure 8:
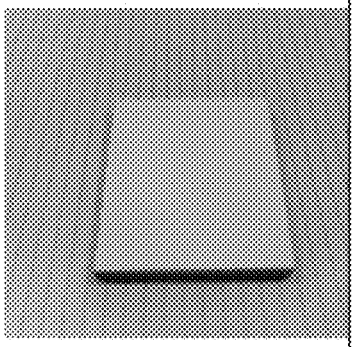
FIG. 8 shows a comparative summary of physical properties of coating layers formed according to Comparative Example 2 and Example 2.
Figure 8:
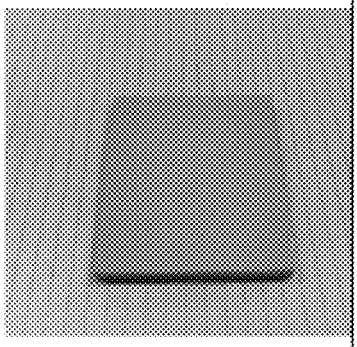
Figure 8:
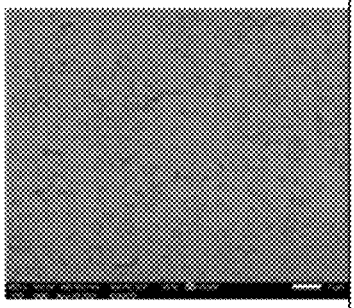
Figure 8:
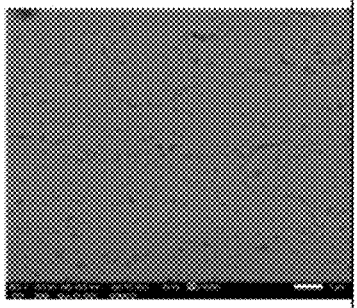

As shown in FIG. 8, with the increased powder heat treatment temperature, such a formed coating layer also has improved mechanical properties. As a result of performing the scratch test as well as measuring the elastic modulus and critical load, the yttria coating layer, according to Example 2, exhibited excellent values.

Experimental Example 3: Analysis of X-Ray Powder Diffraction (XRD)

Empyrean (purchased from PANalytical B.V. Co.) was used to measure XRD pattern of the coating thin layer.

Sample mode: Reflection

Anode material: Cu

X-Ray wavelength: 1.540206 Åm

As shown in FIG. 4, an increase in the collision energy of the powder particles due to the increase in the powder heat treatment temperature increases the ratio of a monoclinic phase.

Experimental Example 4: Energy Dispersive Spectroscopy (EDS)

IT700HR (purchased from JEOL Co.) was used to measure the EDS spectrum of the coating thin layer.

Measurement mode: SED (secondary electron mode)

Acceleration voltage: 20.0 kV

Working distance: 10.0 mm

Probe current: 60.0

Magnification: ×10,000

Experimental Example 5: X-Ray Photoelectron Spectroscopy (XPS)

K-Alpha+(purchased from Thermo Fisher Scientific Inc.) was used to measure the EDS spectrum of the coating thin layer.

Number of scans: 5

Time for scanning: 5.0 s

Beam size: 400 μm

Measurement range: Within 1 μm from surface

Pass energy (CAE): 151.2

Figure 6:
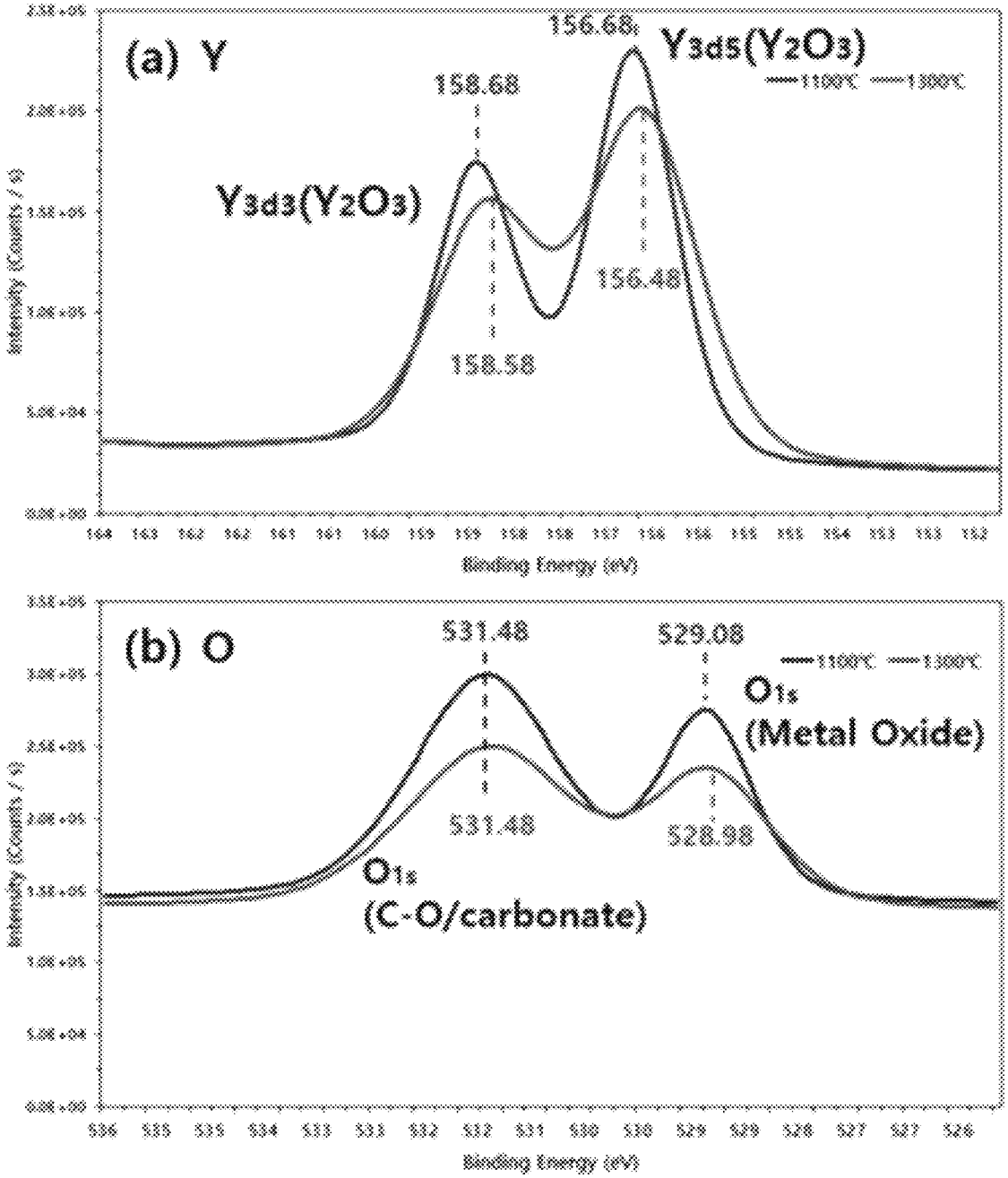
FIG. 6 shows X-ray photoelectron spectroscopy (XPS) results of coating layers formed according to Comparative Example 2 and Example 2.

As shown in FIGS. 5 and 6, EDS analysis and XPS analysis were performed to analyze changes in oxygen vacancies in the coating layer depending on changes in the powder heat treatment temperature.

As a result of the EDS analysis, when the powder heat treatment temperature was increased, the ratio of oxygen was decreased from 22.58% to 20.55%. In addition, as a result of the XPS analysis, when the powder heat treatment temperature was increased, the ratio of Yttrium/Oxide was decreased from 0.535 to 0.505. Referring to these analysis results, it was confirmed that with the increased heat treatment temperature, the oxygen vacancies in the coating layer were increased.

In particular, as a result of the XPS analysis, when the powder heat treatment temperature was increased, it was confirmed that the binding energy between a Y element constituting $Y_2O_3$ and an O element constituting metal oxide decreased. This means that with the increased oxygen vacancies, $Y_2O_3$ bonds are broken, resulting in a change into a $Y_2O_3$, form (loss of oxygen).

Experimental Example 6: Measurement of Color

A chroma meter CR-400 (purchased from Konica Minolta, Inc.) was used to measure the color [L: ranging from 0 (black) to 100 (white), a: + (red) to − (green), and b: + (yellow) to − (blue)] of the coating thin layer.

Experimental Example 7: Measurement of Emissivity

TTS-5X (purchased from JAPAN SENSOR Corporation) was used to measure the emissivity [ranging from 0.0 (shiny mirror) to 1.0 (black body)] of the coating thin layer.

Figure 7A:
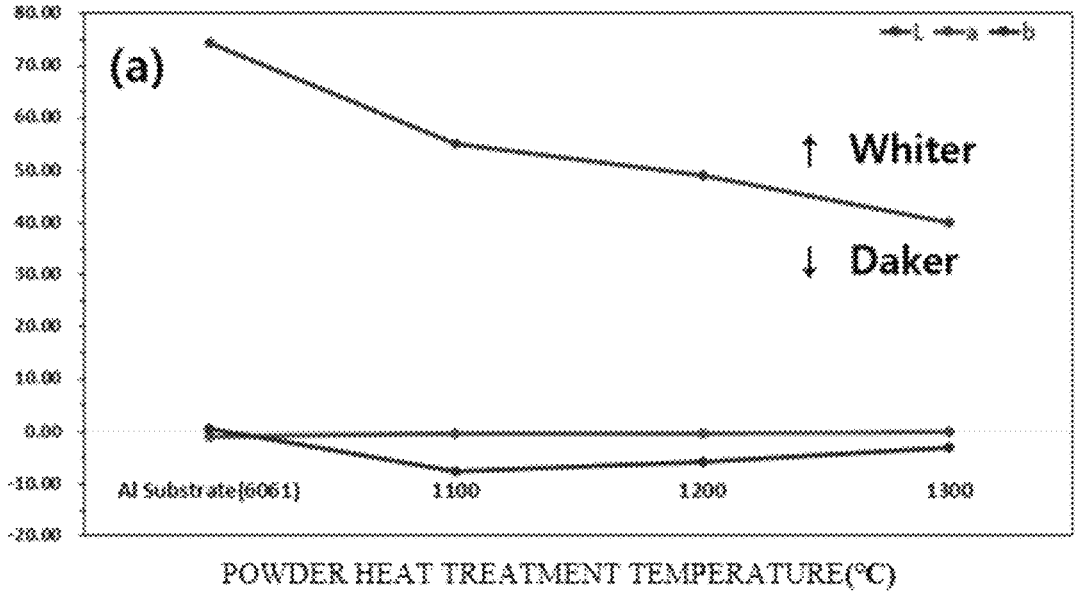
FIGS. 7A and 7B show respective measurement results of the color [L: ranging from 0 (black) to 100 (white), a: + (red) to − (green), and b: + (yellow) to − (blue)] and emissivity [ranging from 0.0 (shiny mirror) to 1.0 (black body)] of an aluminum substrate and coating layers formed according to Comparative Example 2, Example 1, and Example 2.
Figure 7B:
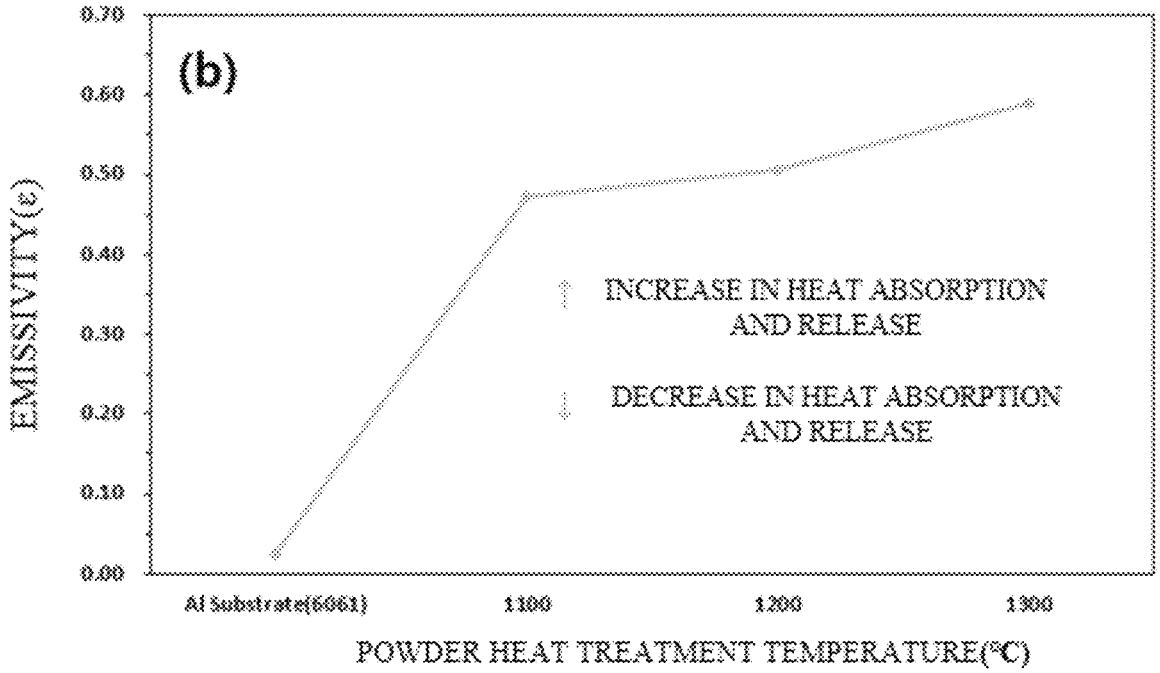

As shown in FIG. 7, the oxygen vacancies formed by the increased powder heat treatment temperature serve as defects inside the coating layer materials and modify the bonding structure. In addition, the oxygen vacancies act as a trap level in the energy band, thereby changing the energy band gap of the materials. Due to the roles of such oxygen vacancies, the color of the coating layer is darkened, and the light absorption rate in the visible light range as well as in the infrared range is increased.

Specific aspects of the present disclosure have been described in detail above, and those skilled in the art will appreciate that these specific aspects are only preferred embodiments, and the scope of the present disclosure is not limited thereby. Thus, the substantial scope of the present disclosure will be defined by the appended claims and their equivalents.

What is claimed is:

1. A method of forming a plasma-resistant coating layer, the method comprising:

(a) performing a heat treatment process in a temperature range of 1,200° C. to 1,400° C. on a primary rare-earth metal compound powder having a grain size in a range of 20 nm to 60 nm to prepare a secondary rare-earth metal compound powder;

(b) transferring the secondary rare-earth metal compound powder from a powder supply device to a deposition chamber; and (c) spraying the transferred secondary rare-earth metal compound powder onto a substrate to form a rare-earth metal compound coating layer on the substrate, wherein the primary rare-earth metal compound powder and the secondary rare-earth metal compound powders are selected from the group comprising yttria ($Y_2O_3$), yttrium fluoride (YF), or yttrium oxyfluoride (YOF), wherein in the transferring, a carrier gas is supplied to transfer the secondary rare-earth metal compound powder, wherein the secondary rare-earth metal compound powder obtained through the heat treatment process has a grain size in a range of 90 nm to 150 nm, wherein in the spraying, the substrate is selected from metal comprising iron, magnesium, aluminum, or alloys thereof; ceramic material comprising $SiO_2$, MgO, $CaCO_3$, or alumina; or polymeric material comprising polyethylene terephthalate, polyethylene naphthalate, polypropylene adipate, or polyisocyanate, and wherein the rare-earth metal compound coating layer has a brightness value of 50 or less.

2. The method of claim 1, wherein in the performing, the heat treatment process is performed in a temperature range of 1,250° C. to 1,350° C.

3. The method of claim 1, wherein the rare-earth metal compound coating layer has a thickness in a range of 1.0 μm to 3.0 μm.

4. The method of claim 1, wherein the rare-earth metal compound coating layer has a porosity in a range of 2 vol % to 5 vol %.

5. The method of claim 1, wherein the rare-earth metal compound coating layer has an adhesive strength of 10,000 mN or higher.

6. The method of claim 1, wherein the secondary rare-earth metal compound powder obtained through the heat treatment process has a grain size in a range of 70 nm to 150 nm and an average diameter (D50) in a range of 8 μm to 12 μm.

* * * * *